United States Patent [19]

Borel et al.

[11] Patent Number: 5,016,678

[45] Date of Patent: May 21, 1991

[54] DOUBLE-LAYER PAPERMAKING FABRIC HAVING A SINGLE SYSTEM OF NON-SYMMETRICALLY EXTENDING LONGITUDINAL THREADS

[75] Inventors: Georg Borel, Reutlingen; Dagmar Arnold, Beuren, both of Fed. Rep. of Germany

[73] Assignee: Hermann Wangner GmbH & Co., Fed. Rep. of Germany

[21] Appl. No.: 350,284

[22] Filed: May 11, 1989

[30] Foreign Application Priority Data

May 19, 1988 [DE] Fed. Rep. of Germany ..... 3817144

[51] Int. Cl.[5] ..... D03D 15/00

[52] U.S. Cl. ..... 139/383 A

[58] Field of Search ..... 139/383 A, 425 A; 428/221, 224, 257; 162/DIG. 1

[56] References Cited

U.S. PATENT DOCUMENTS 4,564,051 1/1986 Odenthal ..... 139/383 A
4,592,395 6/1986 Borel ..... 139/383 A
4,709,732 12/1987 Kinnunen ..... 139/383 A
4,739,803 4/1988 Borel ..... 139/383 A
4,776,373 10/1988 Borel ..... 139/383 A
4,867,206 9/1989 Kufferath ..... 139/383 A

*Primary Examiner*—Andrew M. Falik
*Attorney, Agent, or Firm*—Sughrue, Mion, Zinn, Macpeak & Seas

[57] ABSTRACT

A double-layer fabric for the sheetforming section of a papermaking machine which is referred to as a sheet forming fabric or a dewatering fabric consists of an upper layer (1) of transverse threads (3) and a lower layer (2) of transverse threads (4) and (8) which are interwoven with a single system of longitudinal threads (5). Successive transverse threads (4, 8) of the lower layer (2) form pairs and within each pair the lowest points (7) of the transverse thread floats (6) are in alignment. The lowest point (7) of the float of the one transverse thread (4) of a pair is offset from the center of the float (6) in the direction opposite to the direction in which the lowest point (7) of the float (6) of the other transverse thread (6) is offset.

6 Claims, 3 Drawing Sheets

DOUBLE-LAYER PAPERMAKING FABRIC HAVING A SINGLE SYSTEM OF NON-SYMMETRICALLY EXTENDING LONGITUDINAL THREADS

BACKGROUND OF THE INVENTION

The invention relates to a double-layer fabric for the sheetforming section of a papermaking machine which is a so-called sheet-forming fabric or a dewatering fabric. A double-layer fabric is understood to be a woven fabric in which the transverse threads are disposed in a lower and an upper layer and are generally located one above the other pairwise. The transverse threads are interwoven with a single system of longitudinal threads.

In the formation of the paper sheet in a papermaking machine, the water is removed from the aqueous fiber suspension by means of the dewatering fabric until fiber web is formed on the dewatering fabric which is sufficiently strong to be removed from the forming fabric and to be introduced into the press section.

The dewatering fabric must satisfy many varying requirements, namely a high dewatering efficiency, a fine and planar surface structure on the paper-carrying side, a good fiber retention, a high longitudinal and transverse stability and a high abrasion resistance.

In addition the dewatering fabric must exhibit good running stability, i.e., it may not become distorted and must exhibit perfect straight-run characteristics at speeds of from 1000 to 1500 m/min. and may not drift or run off to the side.

The problem of drifting or running-off of the dewatering fabric toward the side of the machine is not encountered with all types of weaves. It depends primarily upon the symmetry of the transverse thread floats on the running side. In particular, the running side of double-layer forming fabric is formed by transverse thread floats in order to improve the resistance to abrasion and the service life.

A fabric for the sheet-forming section of a papermaking machine is disclosed in U.S. Pat. No. 4,709,732 granted Dec. 1, 1987, This dewatering fabric is a double-layer fabric and the transverse thread floats on the running side are asymmetrical with the lowest point of the transverse thread floats being shifted from the center toward one side. The asymmetrical transverse thread floats lead to an asymmetrical bearing surface of the dewatering fabric with the result that at high speeds the dewatering fabric drifts toward the side. The lateral drifting is highest when a vacuum is applied on the suction boxes for removing residual water from the fiber web. The force by which the dewatering fabric is urged downwards against the papermaking machine is increased through the vacuum whereby the asymmetry of the transverse thread floats has a greater effect. The fabric guide roll must then be set obliquely in order to retain the dewatering fabric in the papermaking machine. If that does not suffice, additional rollers in the papermaking machine must be set obliquely with transversely directed forces resulting therefrom which counteract the lateral drift of the dewatering fabric. If the vacuum of the suction boxes is, for operational reasons of the machine reduced or cut off, the dewatering fabric will escape in the opposite direction by the action of the rollers which are still set obliquely whereby the fabric is frequently damaged on account of the impact as it hits against the framing of the papermaking machine. These difficulties arise especially during the first few days of work with the dewatering fabric, as the asymmetry of the transverse thread floats is during that time still completely present. As abrasion on the running side of the dewatering fabric sets in at the lowest point of the transverse thread floats, the asymmetry of the transverse thread floats becomes less, the longer the dewatering fabric is in use.

It would admittedly be possible to solve the problem of lateral drifting by using a weave with symmetrical transverse floats for the dewatering fabric. With this type of weave there generally exists, however, the drawback that the plane difference between the longitudinal thread floats and the transverse thread floats on the running side are less. Large plane differences are, however, necessary on the running side, since they serve to increase the service life of the dewatering fabric. It is possible when large plane differences are achieved to use thicker transverse threads and to have the transverse thread floats worn down completely by abrasion before the longitudinal threads are exposed to any abrasion.

The asymmetrical transverse thread floats are brought about in that a plurality of longitudinal threads act jointly on one location of the transverse thread float. As consequence, on the one hand, a large plane difference is attained and, on the other hand, the transverse float gets a asymmetrical form, if that location is not disposed in the center of the transverse thread float.

It is known in U.S. Pat. No. 4,592,395 to make the weave to the mirror-image symmetrical in the two halves of the dewatering fabric to the left and to the right of the center line extending in the longitudinal direction, so that the weave diagonal has V-configuration. The difficulty encountered here, however, is that special longitudinal threads must be worked-in in the center of the dewatering fabric in a manner deviating from the remaining weave so as to avoid excessively long transverse thread floats on the running side.

SUMMARY OF THE INVENTION

The present invention solves the problem of how to prevent in the case of a double-layer fabric with asymmetrical transverse thread floats on the running side, any lateral drifting of the fabric. This problem is solved in that the longitudinal threads are woven into the lower layer of the transverse threads in a manner such that successive transverse threads of the lower layer form pairs, the lowest points of the transverse thread floats within a pair being in alignment in longitudinal direction, and the lowest point of the float of the one transverse thread of a pair being offset from the center of the float in the direction opposite to the direction in which the lowest point of the float of the other transverse thread of said pair is offset.

The lateral shift resulting from the asymmetry of the transverse thread floats is balanced out within a transverse thread pair in the case of the fabric according to the invention. An opposite asymmetry of the transverse thread floats can be achieved, for instance, in that each longitudinal thread within a weave repeat is woven twice into the lower layer in a manner such that the weave diagonal on the running side is interrupted or broken.

Each longitudinal thread is expediently woven into the lower layer such that when coming from above it is wound around a transverse thread on the underside, extends over two transverse threads, is again wound around a transverse thread on the underside and then extends between both layers or is woven into the upper layer.

BRIEF DESCRIPTION OF THE DRAWINGS

Illustrative embodiments of the invention shall be explained below by way of the drawings wherein.

DETAILED DESCRIPTION OF THE INVENTION

Figure 4:
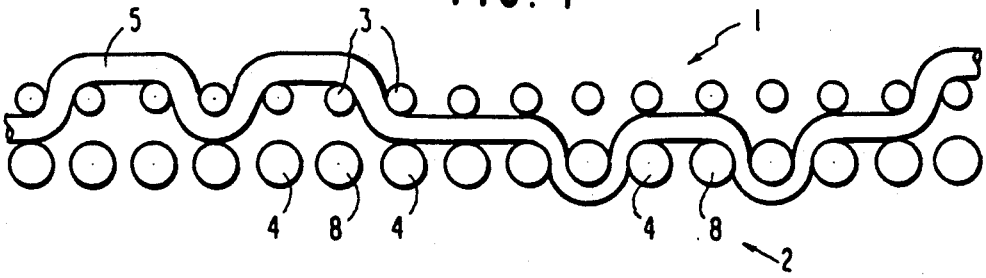
FIG. 4 is a longitudinal sectional view through the dewatering fabric of FIG. 1 showing the course of a longitudinal thread.
Figure 6:
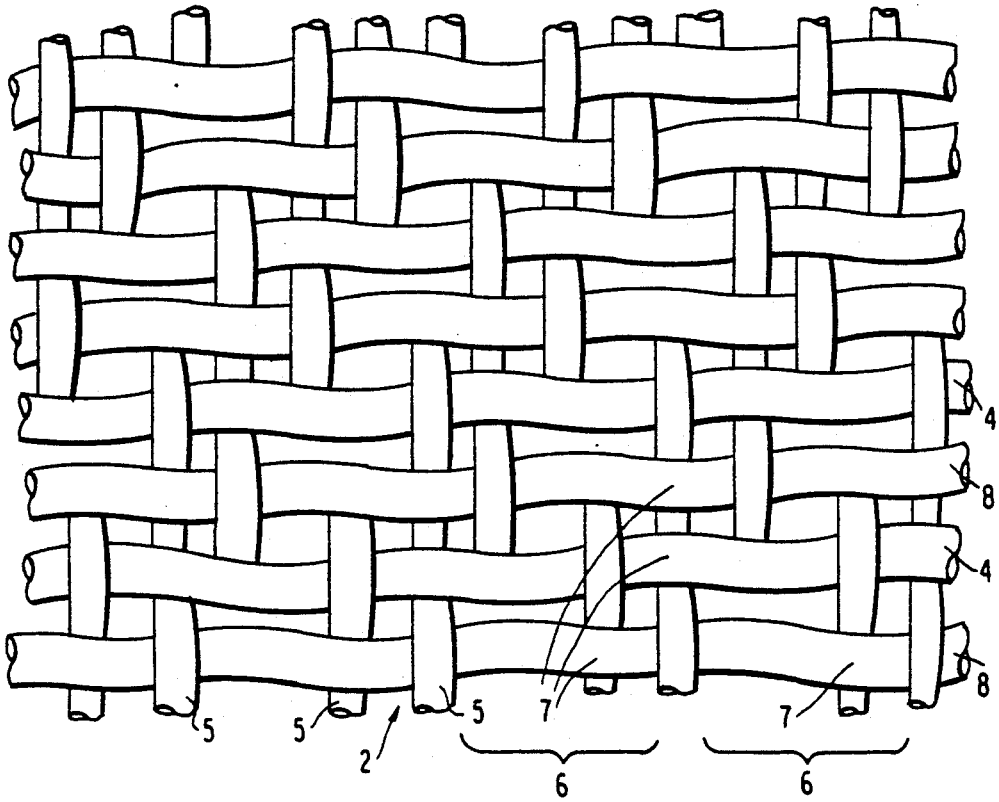
Figure 7:
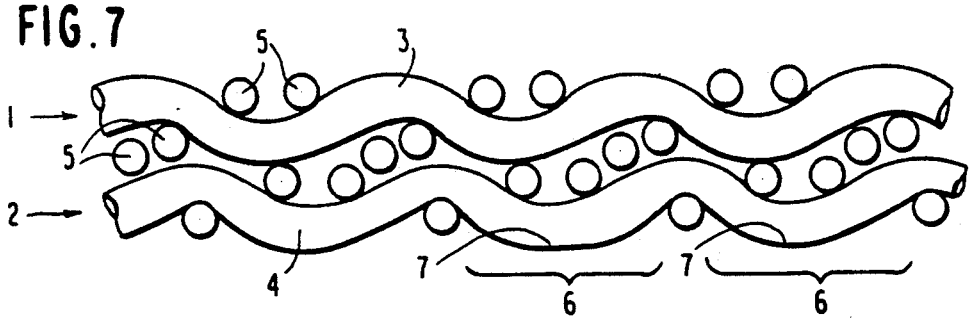
Figure 8:
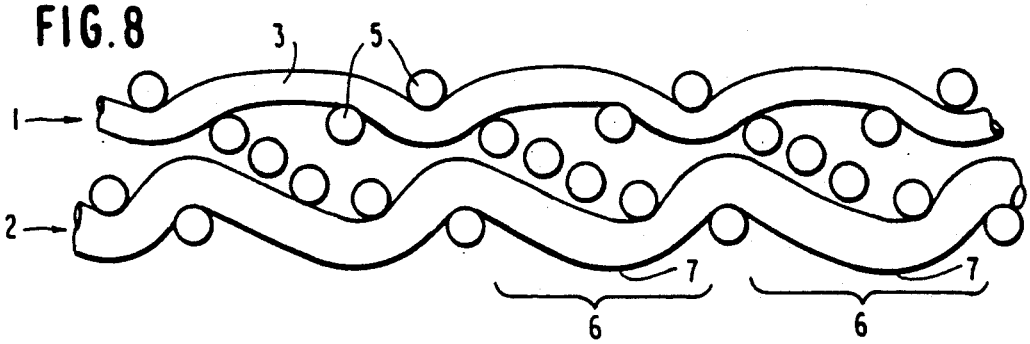

As may be seen in the clearest way from FIG. 4, the dewatering forming fabric of FIGS. 1 to 5 consists of an upper layer 1 of transverse threads 3 and a lower layer 2 of transverse threads 4 and 8 which are interwoven with a single system of longitudinal threads 5. The weave repeat is a 7 harness weave which repeats in the transverse direction after seven longitudinal threads 5 and in longitudinal direction after fourteen transverse threads 3 of the upper layer 1 and fourteen transverse threads 4 and 8 of the lower layer 2. In that regard, each transverse thread 3 of the upper layer 1 is positioned above a transverse thread 4, 8 of the lower layer, so that the transverse thread density is the same in the upper layer 1 and in the lower layer 2. Each longitudinal thread 5 is woven, per repeat, twice into the upper layer 1 in a manner such that it is passed over two transverse threads 3, under one transverse thread 3 and then again over two transverse threads 3 and then to the lower layer 2. In a seven-harness weave, the course of adjacent longitudinal threads may, for instance, always be offset by six transverse threads in one direction, i.e., the so-called count number is six, which is equivalent to a doubled $\frac{3}{4}$ atlas. The weave of the upper layer and hence the structure on the paper side is the same as that shown in U.S. Pat. No. 4,739,803. Accordingly, there exists in the upper layer 1 a heterogeneous supporting of the transverse threads 3, with a transverse thread 3 always being supported by a single longitudinal thread 5 as in a saddle and therefore extending precisely int he transverse direction. The adjacent transverse threads are supported in shearlike manner by two successive longitudinal threads 5, with the one longitudinal thread 5 descending, after completion of the float, to the lower layer 2, as the other longitudinal thread 5 is just ascending from the lower layer 2 in order to float on the paper side. Both types of support of the transverse threads 3 alternate on the paper side. On account of that, successive transverse threads 3 do not form on the paper side any parallel floats but, rather, the floats are disposed at an angle relative to one another, whereby the marking characteristics of this dewatering fabric are improved. After thermofixation, all floats of the longitudinal threads 5 and of the transverse threads 3 on the paper side are disposed in one plane.

Figure 1:
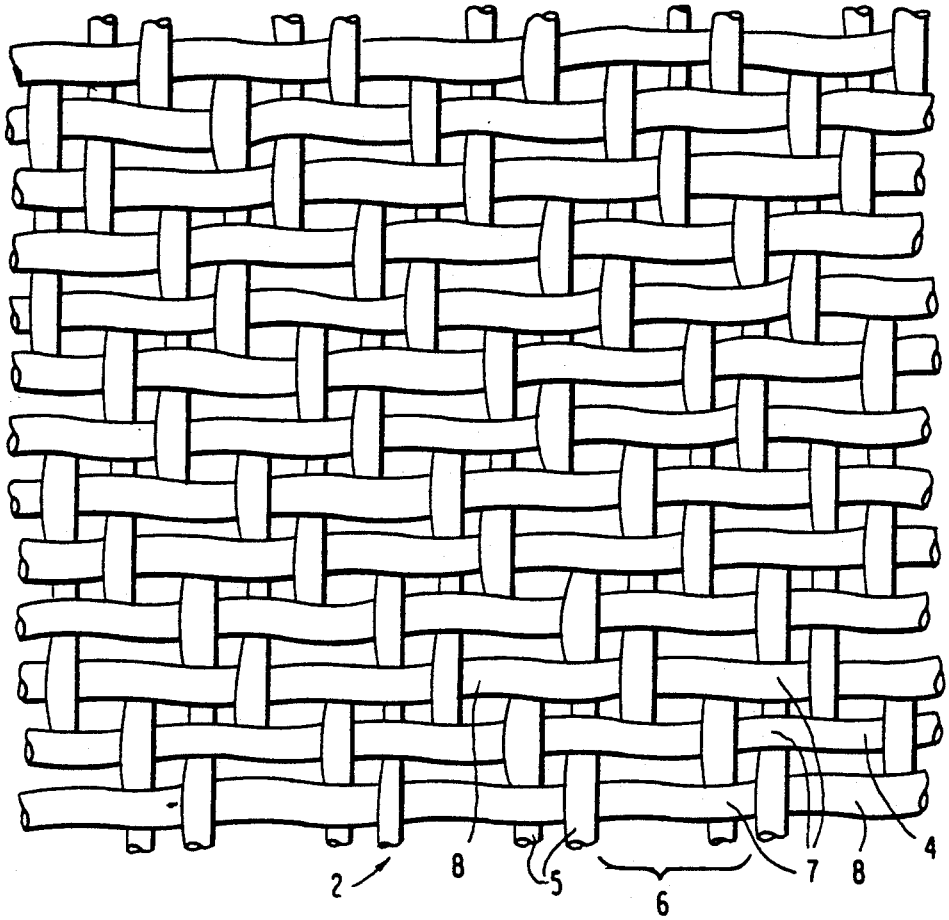
FIG. 1 is a view from the bottom of the running side of a dewatering forming fabric, with changing asymmetry of the transverse thread floats.
Figure 2:
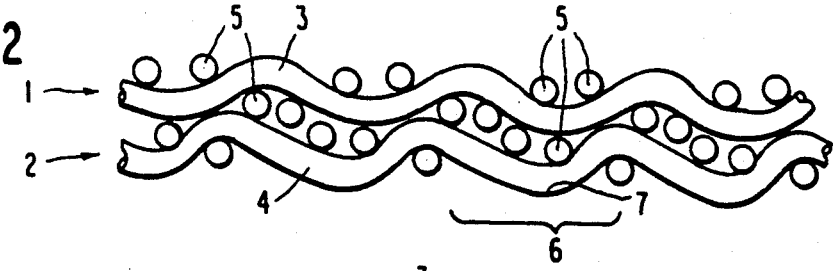
FIG. 2 is a cross-sectional view of the fabric in FIG. 1 showing the course of a transverse thread of the lower layer.
Figure 3:
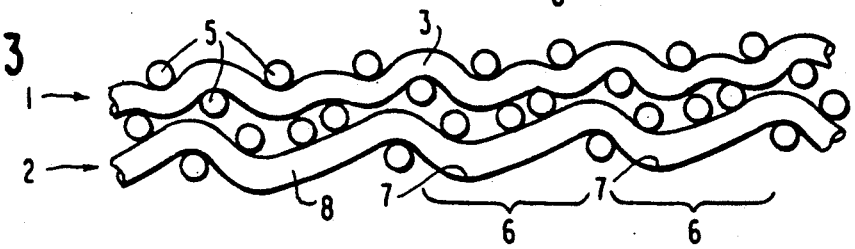
FIG. 3 is a cross-sectional view of the fabric in FIG. 1 showing the course of another transverse thread with opposite asymmetry from the transverse thread shown in FIG. 2.
Figure 9:
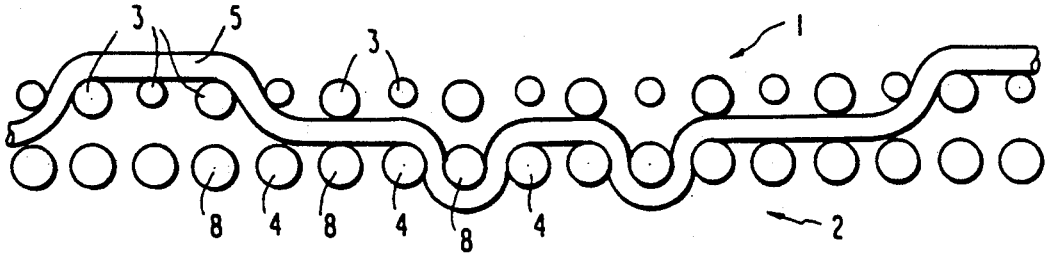
FIGS. 6 to 10 are views corresponding to those of FIGS. 1 to 5 but with a different weave pattern.
Figure 10:
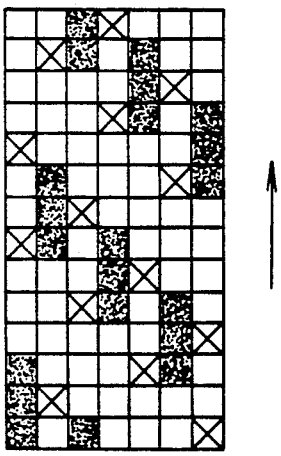

After interweaving into the upper layer 1, the longitudinal thread 5 extends over an intermediate stretch of three transverse threads between the layers 1, 2 and is subsequently thereto likewise interwoven twice with the transverse threads 4, 8 of the lower layer, the longitudinal thread 5 in that connection extending in the interior of the fabric, between these two binding points over two transverse threads 4, 8. Accordingly, in the lower layer 2, the longitudinal thread 5 is wound around a transverse thread 8 on the underside, is positioned over two transverse threads 4, 8 and is again wound around a transverse thread 4 on the underside. Thereupon, there follows an intermediate stretch of two transverse threads to the next binding point into the upper layer 1. The course of the longitudinal thread 5 is unsymmetrical. The weave pattern is irregular in the lower layer 2 in that the first transverse thread 8*a* (FIG. 1 and 5) of a repeat is bound by the second longitudinal thread 5*b*, the second transverse thread 4*b* by the fourth longitudinal thread 5*d*, and in that the third transverse thread 8*c* is not bound by the sixth 5*f* but, rather, by the seventh longitudinal thread 5*g*, the fourth transverse thread 4*d* by the ninth longitudinal thread 5*b* (=second longitudinal thread of the repeat following at the right side) and the fifth transverse thread 8*e* again not by the eleventh (or forth), but rather the twelfth (or fifth) longitudinal thread 5*e*. As a result the desired structure is achieved on the running side, such as it is depicted in FIG. 1, with successive transverse threads 4, 8 when viewed in cross-section (FIGS. 2 and 3) exhibiting asymmetrical floats.

The upper and lower layers 1, 2 are comprised of transverse threads 3, 4, 8 which are interwoven with a system of longitudinal threads 5. The transverse threads 4, 8 of the lower layer 2 form transverse thread floats 6, each having a lowest point 7 which is offset from the center of each float toward one side. Successive transverse threads 4, 8 of the lower layer 2 form pairs and within a pair the lowest point 7 of the transverse thread floats 6 are in alignment in a longitudinal direction and the lowest point 7 of the float of one transverse thread 4 of a pair is offset from the center of said float 6 in the direction opposite to the direction in which the lowest point 7 of the float 6 of the other transverse thread of the pair is offset.

The longitudinal threads 5 have a diameter of 0.15 mm and consist of low-stretch polyester (type 940 by Hoechst). Their density is 63/cm. Subsequent to fixation, the longitudinal thread density increased to 72/cm. In the upper layer 1, transverse threads having a diameter of 0.15 mm and made from soft polyester (type 900 by Hoechst) are interwoven at a density of 34/cm. Transverse threads 4, 8 having a diameter of 0.18 cm are interwoven into the lower layer. Transverse threads 4 consist of a soft polyester (type 900 by Hoechst) and the transverse threads 8 consist of polyamide PA6. The density of the transverse threads was reduced on account of fixation in the upper layer 1 and in the lower layer 2 to 32/cm. After fixation, the uppermost points of all threads on the paper side of the dewatering fabric are located in one plane. The height differential between the transverse threads 4, 8 and the longitudinal threads 5 on the running side is 9.5/100 mm, so that upon use of the dewatering fabric the transverse threads 4. 8 must be completely chafed through before the longitudinal threads 5 chafe through.

In the illustrative embodiment shown in FIGS. 6 to 10, the longitudinal thread 5 in the upper layer 1 passes over three transverse threads 3. The transverse threads 3 alternately have a diameter of 0.18 and 0.12 mm and are woven in a manner such that the center transverse thread 3 within a longitudinal thread float on the paper side is of the smaller diameter. In that regard, the transverse threads 3 of different thickness also take a different course such that the finer transverse threads 3 are lying completely upon the paper side of the dewatering fabric, i.e., the longitudinal thread 5 is never wound around them from the top or, expressed in other words the warp threads 5 never pass over a fine transverse thread 3 and after that between this transverse thread 3 and the successive, thicker transverse thread 3 (EP-A-O 085 353).

Figure 5:
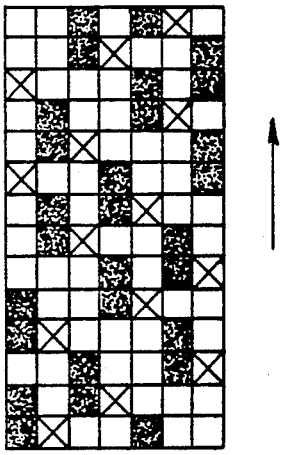
FIG. 5 is a diagrammatic representation of the arrangement of the binding points as seen from the top and wherein a black square indicates the longitudinal thread extends over a transverse thread of the upper layer, a cross indicates the longitudinal thread extends beneath a transverse thread of the lower layer, and the empty squares indicate the longitudinal thread extends between both layers, which is equivalent to the transverse threads being visible at that location on the paper side and on the running side.

In the lower layer 2 the longitudinal thread 5 binds the transverse threads 4, 8 in the same way as in the illustrative embodiment shown in FIG. 1 and 5. In the lower layer 2 the transverse threads 4, 8 have a diameter of 0.20 mm and are likewise made alternately from polyester and polyamide, as in the case of the illustrative embodiment shown in FIGS. 1 to 5.

What is claimed is:

1. A double-layer fabric for the sheet forming section of a papermaking machine, comprising an upper and a lower layer (1, 2) of transverse threads (3, 4, 8) which are interwoven with a system of longitudinal threads (5) to define a plurality of weave repeats, the transverse threads (4. 8) of the lower layer (2) forming transverse threads floats (6) each having a lowest point (7) which is offset from the center of each float towards one side, wherein successive transverse threads (4. 8) of the lower layer (2) form pairs and within a pair the lowest points (7) of the transVerse thread floats (6) are in alignment in longitudinal direction, and the lowest point (7) of the float of the one transverse thread (4) of a pair is offset from the center of said float (6) in the direction opposite to the direction in which the lowest point (7) of the float (6) of the other transverse thread (8) of the pair is offset.

2. A fabric as set forth in claim 1, wherein the longitudinal threads (5) within each fabric weave repeat are woven twice into the lower layer (2) to define two binding points, each longitudinal thread (5), when descending into the lower layer extending beneath a transverse thread (8), over two transverse threads (8, 4) and again beneath a transverse thread (4) of the lower layer (2) and than rising toward the upper layer, and wherein the distribution of the binding points in an atlas distribution on opposite sides of the fabric.

3. A fabric as set forth in claim 1, wherein the weave repeat is a 7-harness weave and encompasses fourteen transverse threads (3) of the upper layer (1) and fourteen transverse threads (4, 8) of the lower layer (2).

4. A fabric as set forth in claim 2, wherein said transverse threads (4, 8) of the lower layer (2), over which the longitudinal thread (5) extends between said binding points form one of the pairs.

5. A fabric as set forth in any one of claims 1 to 4, wherein said longitudinal threads (5) in said upper layer (1) have floats which extend over two transverse threads (3) and wherein the course of each longitudinal thread is nonsymmetrical along the length thereof.

6. A double-layer fabric for the sheet forming section of a papermaking machine comprising an upper and lower layer of transverse threads which are interwoven with a system of longitudinal threads to define a plurality of weave repeats, the transverse threads of the lower layer forming transverse thread floats each having a lowest point which is offset from the center of each float towards one side, wherein successive transverse threads of the lower layer form pairs and within a pair a lowest point of the transverse thread floats are in alignment in longitudinal direction and the lowest point of the float of the one transverse thread of a pair is offset from the center of the float in the direction opposite to the direction in which the lowest point (7) of the float (6) of the other transverse thread of the pair is offset and wherein said longitudinal threads within each fabric weave repeat are woven twice into the lower layer to define two binding pints, each longitudinal thread (5) when descending into the lower layer extending beneath a transverse thread, over two transverse threads and again beneath a transverse thread in the lower layer and then rising toward the upper layer, said transverse threads of the lower layer over which the longitudinal thread extends between said binding points forms one of the pairs and wherein the distribution of the binding points is an atlas distribution on opposite sides of the fabric.

* * * * *